US008115726B2

(12) United States Patent
Tsai

(10) Patent No.: US 8,115,726 B2
(45) Date of Patent: Feb. 14, 2012

(54) LIQUID CRYSTAL DISPLAY IMAGE PRESENTATION

(75) Inventor: Leonard Tsai, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1145 days.

(21) Appl. No.: 11/925,371

(22) Filed: Oct. 26, 2007

(65) Prior Publication Data

US 2009/0109159 A1 Apr. 30, 2009

(51) Int. Cl.
*G09G 3/36* (2006.01)

(52) U.S. Cl. ..... 345/99; 345/90; 345/98

(58) Field of Classification Search ..... 345/98
See application file for complete search history.

(56) References Cited

U.S. PATENT DOCUMENTS

| | | | | |
|---|---|---|---|---|
| 5,124,691 | A * | 6/1992 | Sakamoto et al. | 715/799 |
| 5,402,148 | A * | 3/1995 | Post et al. | 345/698 |
| 5,546,104 | A * | 8/1996 | Kuga | 345/99 |
| 5,555,527 | A * | 9/1996 | Kotani et al. | 365/222 |
| 6,064,359 | A * | 5/2000 | Lin et al. | 345/89 |
| 6,222,512 | B1 * | 4/2001 | Tajima et al. | 345/63 |
| 6,243,055 | B1 * | 6/2001 | Fergason | 345/32 |
| 6,329,973 | B1 * | 12/2001 | Akimoto et al. | 345/98 |
| 6,333,948 | B1 * | 12/2001 | Kurobe et al. | 375/240.13 |
| 6,888,517 | B2 * | 5/2005 | Ikemoto | 345/67 |
| 7,119,803 | B2 * | 10/2006 | Stanley et al. | 345/211 |
| 7,463,272 | B2 * | 12/2008 | Damera-Venkata | 345/694 |
| 7,499,043 | B2 * | 3/2009 | Vasqnez et al. | 345/212 |
| 7,600,874 | B2 * | 10/2009 | Childers et al. | 353/31 |
| 7,692,642 | B2 * | 4/2010 | Wyatt | 345/211 |
| 7,898,535 | B2 * | 3/2011 | Juenger | 345/204 |
| 2002/0003522 | A1 * | 1/2002 | Baba et al. | 345/89 |
| 2002/0015104 | A1 * | 2/2002 | Itoh et al. | 348/459 |
| 2002/0018058 | A1 * | 2/2002 | Tamura | 345/204 |
| 2002/0093473 | A1 * | 7/2002 | Tanaka et al. | 345/87 |
| 2003/0020699 | A1 * | 1/2003 | Nakatani et al. | 345/204 |
| 2003/0035594 | A1 * | 2/2003 | Kondo et al. | 382/298 |
| 2003/0071775 | A1 * | 4/2003 | Ohashi et al. | 345/89 |
| 2003/0122773 | A1 * | 7/2003 | Washio et al. | 345/103 |
| 2003/0218618 | A1 * | 11/2003 | Phan | 345/629 |
| 2004/0075769 | A1 * | 4/2004 | Shy et al. | 348/565 |
| 2005/0110796 | A1 * | 5/2005 | Flowers et al. | 345/589 |
| 2005/0134735 | A1 * | 6/2005 | Swartz | 348/554 |
| 2005/0134739 | A1 * | 6/2005 | Bian | 348/600 |
| 2005/0264692 | A1 * | 12/2005 | Hoshino et al. | 348/452 |
| 2006/0066554 | A1 * | 3/2006 | Baba et al. | 345/98 |
| 2006/0072664 | A1 * | 4/2006 | Kwon et al. | 375/240.16 |
| 2006/0146056 | A1 * | 7/2006 | Wyatt | 345/501 |
| 2006/0170822 | A1 * | 8/2006 | Baba et al. | 348/500 |
| 2006/0181642 | A1 * | 8/2006 | Hamada et al. | 348/452 |
| 2006/0267972 | A1 * | 11/2006 | Yi | 345/211 |
| 2008/0143728 | A1 * | 6/2008 | Gorla et al. | 345/501 |

FOREIGN PATENT DOCUMENTS

GB 2381931 A * 5/2003

* cited by examiner

*Primary Examiner* — Richard Hjerpe
*Assistant Examiner* — Dorothy Harris

(57) ABSTRACT

A display device comprises a liquid crystal module comprising a matrix of pixels, a backlight assembly, and a controller comprising logic to receive an image comprising at least a first stationary portion and a second moving portion, separate the first stationary portion from the second moving portion, present the first stationary portion at a first refresh rate and present the second moving portion at a second refresh rate, different from the first refresh rate.

21 Claims, 4 Drawing Sheets

LIQUID CRYSTAL DISPLAY IMAGE PRESENTATION

BACKGROUND

Many electronic devices include color liquid crystal displays (LCDs). Some LCDs utilize a white backlight, which is passed through at least one color filter to make different colors available to the LCD screen. Pixels on the LCD screen are arranged to groups of three, which include a red pixel, a green pixel, and a blue pixel. By managing the intensity of the red, green, and blue pixels, colors are presented on the screen.

Liquid crystal display devices have relatively high capacitance, which results in relatively slow response times. Thus, video or graphic streams which include regions of high motion may exhibit blurring when displayed on the liquid crystal display. The blurring reduces image quality. Thus, liquid crystal display assemblies that include or implement techniques to reduce motion-induced blurring may find utility.

DETAILED DESCRIPTION

Described herein are exemplary systems and methods for implementing image presentation in a liquid crystal display. In the following description, numerous specific details are set forth to provide a thorough understanding of various embodiments. However, it will be understood by those skilled in the art that the various embodiments may be practiced without the specific details. In other instances, well-known methods, procedures, components, and circuits have not been illustrated or described in detail so as not to obscure the particular embodiments.

Figure 1B:
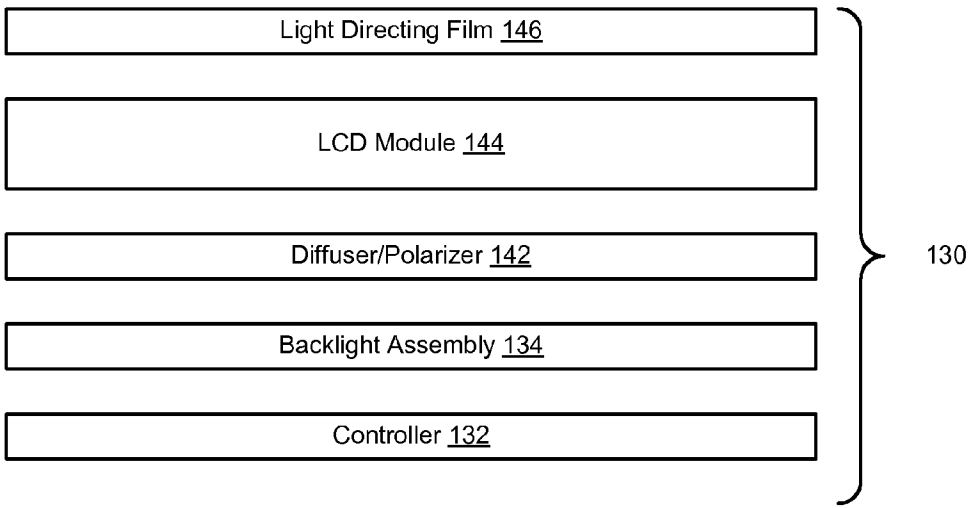
FIG. 1B is an exploded, side view of a LCD assembly, according to an embodiment.
Figure 1A:
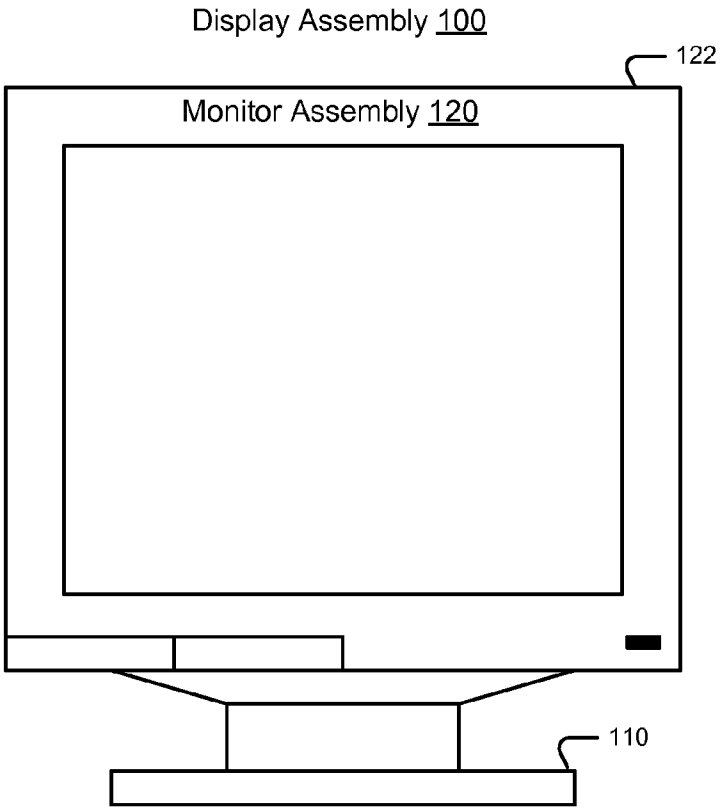
FIG. 1A is a schematic, front view of a LCD assembly, according to an embodiment.

FIG. 1A is a schematic, front view of a LCD assembly, according to an embodiment, and FIG. 1B is an exploded, side view of a LCD assembly, according to an embodiment. Referring to FIG. 1A, a display assembly 100 comprises a base 110 and a monitor assembly 120 coupled to the base. Monitor assembly 120 comprises a housing 122, which houses a LCD assembly 130.

Referring to FIG. 1B, LCD assembly 130 comprises a timing controller 132, a backlight assembly 134, a diffuser 142, a LCD module 144, and a light directing film 146. Display assembly 100 may be embodied as any type of color graphics display. In one embodiment, LCD module 144 may comprise a thin film transistor (TFT) assembly. In other embodiments, the LCD module 144 may embodied as a different type of LCD, e.g., a diode matrix or another capacitively driven LCD, a digital mirror assembly, or the like.

A diffuser 142 is positioned adjacent the backlight assembly 134. In some embodiments, diffuser 142 may also act as a polarizer to polarize light emitted by the arrays of LEDs 136, 138, 140. A LCD module 144 is positioned adjacent diffuser 142. In some embodiments, LCD module may be a twisted nematic LCD, an In-plane switching LCD, or a vertical alignment (VA) LCD. In some embodiments, a light directing film 146 may be positioned adjacent the LCD to enhance the brightness of the display.

Figure 3:
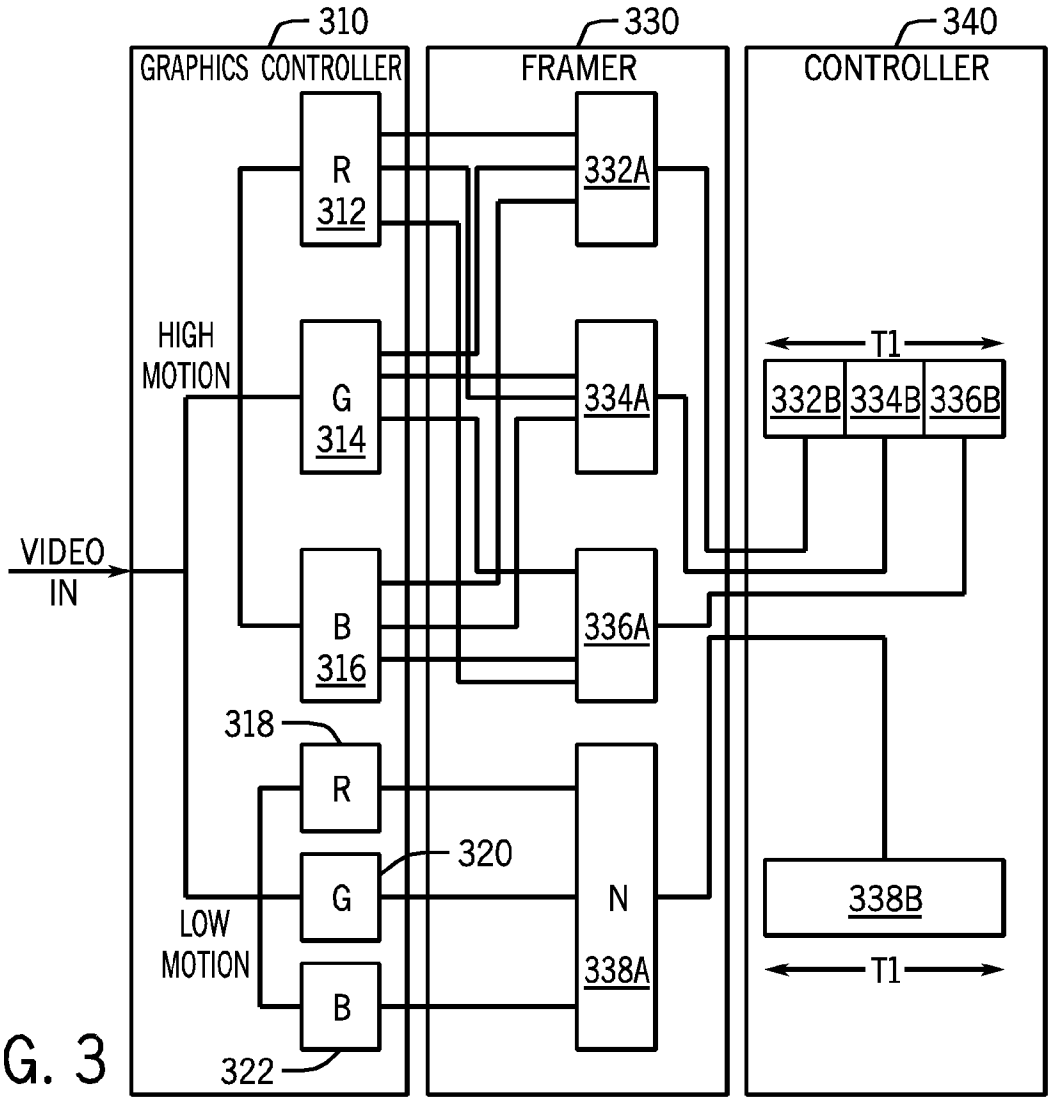
FIG. 3 is a schematic illustration of components of a display system adapted to implement liquid crystal display image presentation, according to an embodiment.
Figure 2:
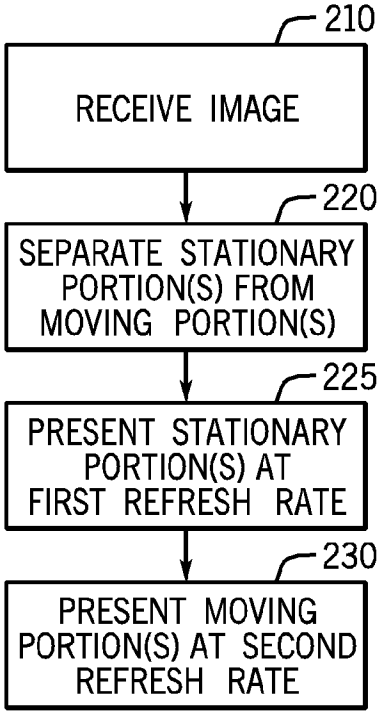
FIG. 2 is a flowchart illustrating operations in an embodiment of a method for liquid crystal display image presentation.
Figure 4:
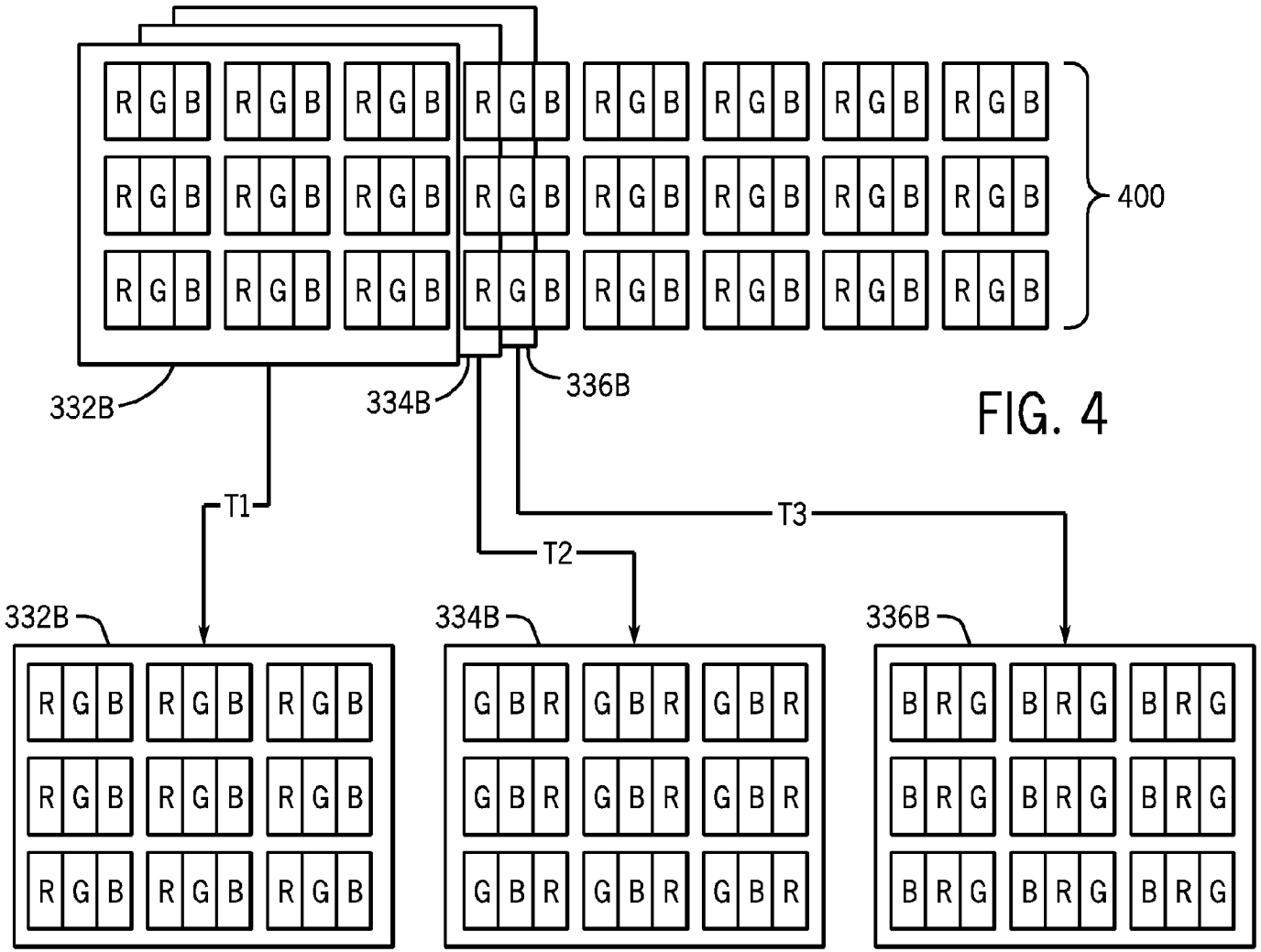
FIG. 4 is a schematic illustration of a portion of a liquid crystal display in which pixels are shifted to implement liquid crystal display image presentation, according to an embodiment.

In some embodiments, a liquid crystal display device may be adapted to implement operations for image presentation that accommodate both regions of high motion and regions of low motion. Structural components of such a liquid crystal display device and associated operations will be explained with reference to FIGS. 2-4. FIG. 2 is a flowchart illustrating operations in an embodiment of a method for liquid crystal display image presentation. FIG. 3 is a schematic illustration of components of a display system adapted to implement liquid crystal display image presentation, according to an embodiment. FIG. 4 is a schematic illustration of a portion of a liquid crystal display in which pixels are shifted to implement liquid crystal display image presentation, according to an embodiment.

In some embodiments, the operations depicted in FIG. 2 may be implemented by a controller such as the controller 132 depicted in FIG. 1B, alone or in combination with a graphics controller or another controller is part of a computing system.

Referring to FIG. 2, at operation 210 an image is received in the controller. For example, in the embodiment depicted in FIG. 3 an image comprising video and/or graphics content is received in graphics controller 310. At operation 220 the stationary, or low-motion, portions of the received image are separated from the moving, or high-motion portions of the received image. For example, in some embodiment the graphics controller 310 may implement a routine which analyzes corresponding pixels in successive image frames to separate low-motion pixels from high-motion pixels. The result of such analysis may be accumulated as history data and tracked continuously. Regions of the image in which there are significant changes between corresponding pixels in successive image frames may be classified as high motion regions. By contrast, regions of the image in which there are not significant changes between corresponding pixels in successive image frames may be classified as low motion regions.

At operation 225 the stationary, or low-motion, regions of the image are presented on the display at a first refresh rate, and that operation 230 the moving, or high-motion, regions of the image are presented on the display at a second refresh rate. In some embodiments the second refresh rate is approximately three times faster than the first refresh rate.

Referring again to FIG. 3, high-motion regions of the video are broken down into their constituent red, green, and blue components, as indicated by blocks 312, 314, and 316. Similarly, low-motion regions of the video are broken down into their constituent red, green, and blue components, as indicated by blocks 318, 320 and 322. The red, green, and blue components 312, 314, and 316 are passed to a framer 330 where they are inserted into three separate frames indicate by blocks 332A, 334A, and 336A. The red, green, and blue components 318, 320 and 322 are passed to the framer 330 where they are inserted into a single frame indicated by block 338A.

The frames indicated by block's 332A, 334A, 336A, 338A are passed to a controller 340 (frames 332A, 334A, 336A, and 338A in the framer 330 correspond to frames 332B, 334B, 336B, and 338B, respectively, in the controller 340). In one embodiment, controller 340 may correspond to the controller 132 depicted in FIG. 1B, and may implement timing control operations and frame control operations of a display. Controller 340 presents the frame 338B from the low motion portion of the video input on the display at a first refresh rate indicated in FIG. 3 by the timing arrow T1. By contrast, controller 340 presents the frames 332B, 334B, and 336B from the high motion portion of the video input on the display at a second refresh rate such that all three frames are presented during the time period T1 represented by the first refresh rate. For example, in one embodiment the second refresh rate may be approximately three times the first refresh rate.

Thus, the structure and operations depicted in FIGS. 2-3 permit a liquid crystal display to implement a time-multiplexing process pursuant to which high-motion components of a video stream are presented at a higher refresh rate than low-motion components of a video input. One skilled in the art will recognize that the operations implemented by FIG. 3 may be performed on individual pixels in an image, or on groups of one or more pixels in an image. Such groups of one or more pixels can be rectangular or other shapes. Thus, the structure depicted in FIG. 3 may implemented as logic circuitry, and may be replicated as necessary in order to process pixels in parallel to achieve desired performance standards.

In addition to the time multiplexing function implemented by FIGS. 2-3, a pixel shifting operation may be implemented in which frames 332B, 334B, and 336B of the high-motion portion(s) of the video input are shifted during the presentation on the display. Such separation of high motion pixels from the low motion pixels to apply different operation inhibits low motion pixels from being processed through the shifting operation. This can prevent undesired image jitter of low motion, high frequency display area such as overlay text (i.e., captions or subtitles).

Referring to FIG. 4, pixels on a color liquid crystal display 400 are arranged to groups of three, which include a red pixel, a green pixel, and a blue pixel. In one embodiment the controller 340 shifts frames 332B, 334B, and 336B by one pixel during the refresh cycle. Thus, frame 332B is displayed at time T1 across an array of pixels arranged in red-green-blue (RGB) order. During the next refresh cycle frame 334B is displayed at time T2 and shifted one pixel such that frame 334B is displayed across an array of pixels arranged in GBR order. During the next refresh cycle frame 336B is displayed at time T3 and shifted one pixel such that frame 336B is displayed across an array of pixels arranged in BRG order.

The time multiplexing of high-motion pixels, alone or in combination with the physical shifting of the frame position associated with high-motion pixels on the display reduces motion-induced blurring in image display.

Figure 5:
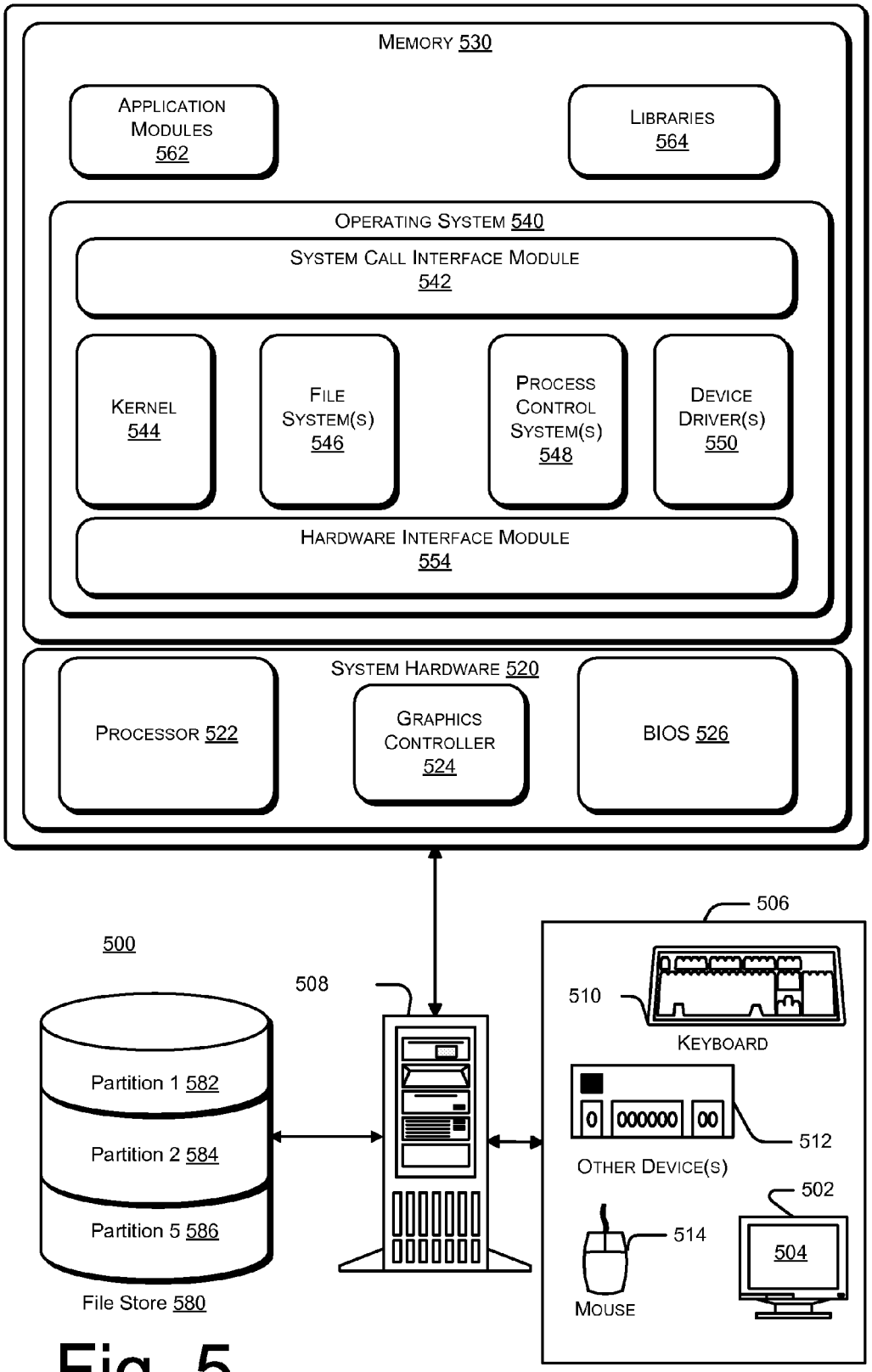
FIG. 5 is a schematic illustration of a computing system which includes a liquid crystal display that implements image presentation, according to an embodiment.

In some embodiments, a display assembly may be distributed as a component of a computer system. FIG. 5 is a schematic illustration of a computing system which includes a liquid crystal display that implements image presentation, according to an embodiment. The components shown in FIG. 5 are only examples, and are not intended to suggest any limitation as to the scope of the functionality of the invention; the invention is not necessarily dependent on the features shown in FIG. 5. In the illustrated embodiment, computer system 500 may be embodied as a hand-held or stationary device for accessing the Internet, a desktop PCs, notebook computer, personal digital assistant, or any other processing devices that have a basic input/output system (BIOS) or equivalent.

The computing system 500 includes a computer 508 and one or more accompanying input/output devices 506 including a display 502 having a screen 504, a keyboard 510, other I/O device(s) 512, and a mouse 514. The other device(s) 512 may include, for example, a touch screen, a voice-activated input device, a track ball, and any other device that allows the system 500 to receive input from a developer and/or a user.

The computer 508 includes system hardware 520 commonly implemented on a motherboard and at least one auxiliary circuit boards. System hardware 520 including a processor 522 and a basic input/output system (BIOS) 526. BIOS 526 may be implemented in flash memory and may comprise logic operations to boot the computer device and a power-on self-test (POST) module for performing system initialization and tests. In operation, when activation of computing system 500 begins processor 522 accesses BIOS 526 and shadows the instructions of BIOS 526, such as power-on self-test module, into operating memory. Processor 522 then executes power-on self-test operations to implement POST processing.

Graphics controller 524 may function as an adjunction processor that manages graphics and/or video operations. Graphics controller 524 may be integrated onto the motherboard of computing system 500 or may be coupled via an expansion slot on the motherboard.

Computer system 500 further includes a file store 580 communicatively connected to computer 508. File store 580 may be internal such as, e.g., one or more hard drives, or external such as, e.g., one or more external hard drives, network attached storage, or a separate storage network. In some embodiments, the file store 580 may include one or more partitions 582, 584, 586.

Memory 530 includes an operating system 540 for managing operations of computer 508. In one embodiment, operating system 540 includes a hardware interface module 554 that provides an interface to system hardware 520. In addition, operating system 540 includes a kernel 544, one or more file systems 546 that manage files used in the operation of computer 508 and a process control subsystem 548 that manages processes executing on computer 508. Operating system 540 further includes one or more device drivers 550 and a system call interface module 542 that provides an interface between the operating system 540 and one or more application modules 562 and/or libraries 564. The various device drivers 550 interface with and generally control the hardware installed in the computing system 500.

In operation, one or more application modules 562 and/or libraries 564 executing on computer 508 make calls to the system call interface module 542 to execute one or more commands on the computer's processor. The system call interface module 542 invokes the services of the file systems 546 to manage the files required by the command(s) and the process control subsystem 548 to manage the process required by the command(s). The file system(s) 546 and the process control subsystem 548, in turn, invoke the services of the hardware interface module 554 to interface with the system hardware 520. The operating system kernel 544 can be generally considered as one or more software modules that are responsible for performing many operating system functions.

The particular embodiment of operating system 540 is not critical to the subject matter described herein. Operating system 540 may be embodied as a UNIX operating system or any derivative thereof (e.g., Linux, Solaris, etc.) or as a Windows® brand operating system or another operating system.

Reference in the specification to "one embodiment" or "an embodiment" means that a particular feature, structure, or characteristic described in connection with the embodiment is included in at least an implementation. The appearances of the phrase "in one embodiment" in various places in the specification are not necessarily all referring to the same embodiment.

Thus, although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. A method to present an image on a display device, comprising:

receiving, in a graphics controller, an image comprising at least a first stationary portion and a second moving portion;

separating the first stationary portion from the second moving portion;

presenting the first stationary portion at a first refresh rate, where the first stationary portion has a first number of frames presented within a particular refresh period;

presenting the second moving portion at a second refresh rate, different from the first refresh rate, wherein the second moving portion has a second, larger number of frames presented within the particular refresh period;

generating at least two copies of the second moving portion; and presenting a first copy of the second moving portion at a first location on the display device during a first refresh cycle and a second copy of the second moving portion at a second location on the display device during a second refresh cycle.

2. The method of claim 1, wherein separating the first stationary portion from the second moving portion comprises analyzing, by a graphics controller, pixels in successive image frames received by the graphics controller to separate low-motion pixels from high-motion pixels, the method further comprising a framer producing, from the image, the first number of frames and the second number of frames.

3. The method of claim 1, further comprising:

generating a third copy of the second moving portion; and presenting the third copy of the second moving portion at a third location on the display device during a third refresh cycle.

4. The method of claim 3, wherein:

the display device comprises a matrix of pixels;

different ones of first, second, and third copies of the second moving portion is shifted by a predetermined number of pixels during different ones of the first, second, and third refresh cycles.

5. The method of claim 4, wherein the second refresh rate is multiple times greater than the first refresh rate.

6. The method of claim 1, wherein the second number is multiple times the first number.

7. The method of claim 1, wherein the first number is one, and the second number is three.

8. The method of claim 1, wherein the first number of frames and the second number of frames contain data of the image.

9. The method of claim 1, wherein the second number of frames includes the at least two copies.

10. A display device, comprising:

a liquid crystal module comprising a matrix of pixels;

a backlight assembly; and a controller comprising logic to:

receive an image comprising at least a first stationary portion and a second moving portion;

separate the first stationary portion from the second moving portion;

present the first stationary portion at a first refresh rate;

present the second moving portion at a second refresh rate, larger than the first refresh rate, wherein the second refresh rate is multiple times the first refresh rate;

generate at least two copies of the second moving portion; and present a first copy of the second moving portion at a first location on the display device during a first refresh cycle and a second copy of the second moving portion at a second location on the display device during a second refresh cycle.

11. The display device of claim 10, wherein the controller further comprises logic to analyze pixels in successive image frames to separate low-motion pixels from high-motion pixels to identify the first stationary portion and the second moving portion.

12. The display device of claim 10, wherein the controller further comprises logic to:

generate a third copy of the second moving portion; and present the third copy of the second moving portion at a third location on the display device during a third refresh cycle.

13. The display device of claim 12, wherein:

the controller further comprises logic to shift different ones of the first, second, and third copies of the second moving portion by a predetermined number of pixels during different ones of the first, second, and third refresh cycles.

14. The display device of claim 13, wherein the second refresh rate is three times greater than the first refresh rate.

15. The display device of claim 10, wherein the first stationary portion includes a first number of frames containing data of the image, and wherein the second moving portion includes a second, larger number of frames containing data of the image, the controller to present the first number of frames in a particular refresh period, and to present the second number of frames in the particular refresh period.

16. The display device of claim 15, wherein the second number is an integer multiple of the first number.

17. A computing device, comprising:

a processor; and a display device, comprising:

a liquid crystal module comprising a matrix of pixels;

a backlight assembly; and a controller comprising logic to:

receive an image comprising at least a first stationary portion and a second moving portion;

separate the first stationary portion from the second moving portion;

present the first stationary portion at a first refresh rate, where the first stationary portion has a first number of frames to be presented within a particular refresh period;

present the second moving portion at a second refresh rate, different from the first refresh rate, wherein the second moving portion has a second, larger number of frames to be presented within the particular refresh period;

generate at least two copies of the second moving portion; and present a first copy of the second moving portion at a first location on the display device during a first refresh cycle and a second copy of the second moving portion at a second location on the display device during a second refresh cycle.

18. The computing device of claim 17, wherein the controller further comprises logic to analyze pixels in successive image frames received by the controller to separate low-motion pixels from high-motion pixels.

19. The computing device of claim 17, wherein the controller further comprises logic to:

generate a third copy of the second moving portion; and present the third copy of the second moving portion at a third location on the display device during a third refresh cycle.

20. The computing device of claim 19, wherein:

the controller is to shift different ones of the first, second, and third copies of the second moving portion by a predetermined number of pixels during different ones of the first, second, and third refresh cycles.

21. The computing device of claim 20, wherein the second refresh rate is three times greater than the first refresh rate.

* * * * *